US005085422A

United States Patent [19]

Sagara

[11] Patent Number: 5,085,422

[45] Date of Patent: Feb. 4, 1992

[54] IMAGE FORMING APPARATUS

[75] Inventor: Seiji Sagara, Kawasaki, Japan

[73] Assignee: Canon Kabushiki Kaisha, Tokyo, Japan

[21] Appl. No.: 580,562

[22] Filed: Sep. 11, 1990

[30] Foreign Application Priority Data

Sep. 16, 1989 [JP] Japan ..... 1-240425

[51] Int. Cl.[5] ..... B65H 1/00

[52] U.S. Cl. ..... 271/162; 271/145

[58] Field of Search ..... 271/145, 162, 163, 207; 312/185, 190

[56] References Cited

U.S. PATENT DOCUMENTS 4,421,401 12/1983 Kagiura et al. ..... 355/3 FU
4,878,087 10/1989 Sakai et al. ..... 271/258 X
5,002,266 3/1991 Kikuchi et al. ..... 271/3

FOREIGN PATENT DOCUMENTS 285139 12/1987 European Pat. Off. .
0235352 10/1986 Japan ..... 271/207
0070625 3/1990 Japan ..... 271/162

*Primary Examiner*—H. Grant Skaggs
*Assistant Examiner*—Carol Lynn Druzbick
*Attorney, Agent, or Firm*—Fitzpatrick, Cella, Harper & Scinto

[57] ABSTRACT

An image forming apparatus includes a main body, a paper-feed unit, a paper-feed unit openably and closably supported by the main body of the apparatus, a tray openably and closably supported by the paper-feed unit so as to be swingable between a non-operating position wherein the tray is housed in the paper-feed unit in a generally vertical state and an operating position for mounting a sheet material wherein the tray is opened from the paper-feed unit and is positioned in a generally horizontal state, and a stopper provided in the main body of the apparatus for holding the tray at the operating position contacting the tray. The paper-feed unit can be opened and closed while the tray is held at the operating position.

12 Claims, 9 Drawing Sheets

IMAGE FORMING APPARATUS

BACKGROUND OF THE INVENTION

1. Field of the Invention

This invention relates to an image forming apparatus, such as a copier, a printer or the like, and more particularly, to an image forming apparatus in which a paper-feed or paper-discharge tray is swingably supported on its related unit member, which unit member is openably and closably mounted on the main body of the apparatus.

2. Description of the Related Art

Heretofore, in accordance with the tendency toward smaller copiers or printers, paper-feed or paper-discharge trays have generally been configured so that they extend outside the main body of the apparatus and are detached from or folded within the main body until needed.

A detachable tray has, however, the disadvantages that, for example, it is troublesome to detach and reattach the tray, and the tray is apt to be damaged or lost as a result of handling.

A foldable tray has the disadvantage that, for example, a sheet material (transfer material) on the tray must be temporarily removed at every operation of processing for removing jamming or the like, and the transfer material is apt to be dropped and damaged at that time.

SUMMARY OF THE INVENTION

The present invention has been made in consideration of the above-described disadvantages of conventional devices.

It is an object of the present invention to provide an image forming apparatus in which the attitude of a paper-feed or paper-discharge tray is maintained even if an openable and closable unit member is opened and closed.

The foregoing and other objects are accomplished, according to one aspect of the present invention, by an image forming apparatus comprising a main body, a paper feed unit which is an openable and closable member openably and closably supported on the main body, a tray swingably supported on the openable and closable paper feed unit so as to be swingable between a non-operating position wherein the tray is housed in the paper feed unit and an operating position wherein the tray is opened to a generally horizontal position, and a stopper provided in the main body for anchoring the tray at its operating position.

According to another aspect, the center of opening and closing movement of the openable and closable member and the center of swinging movement of the tray are situated on nearly identical axes.

According to another aspect, the openable and closable member and the tray are formed in a unit structure detachable as one body from the main body.

According to another aspect, the tray is a paper-feed tray.

According to another aspect, the tray is a paper-discharge tray.

According to the above-described structure, when the image forming apparatus is housed, the openable and closable member is closed within the main body, and the tray is housed within the openable and closable member. When the image forming apparatus is used, the tray is opened and anchored to the stopper provided at the main body. The tray thus has an operating attitude.

It is, for example, possible to perform maintenance of the inside of the image forming apparatus by swinging the openable and closable member relative to the tray while the tray is anchored to the stopper, and opening the openable and closable member relative to the main body.

When the openable and closable member is opened relative to the main body while the tray is anchored to the stopper, the attitude of the tray hardly changes.

As explained above, since the openable and closable member is opened and closed relative to the main body of the image forming apparatus and the tray is swingable relative to the openable and closable member, the tray is not detached from the main body of the apparatus and can therefore be prevented from being lost.

Futhermore, when the tray is housed within the openable and closable member, the tray can be seen as a part from the outside, and hence appearance of the main body of the apparatus can be improved.

An advantage of the present invention is that, since the openable and closable paper feed unit can be opened and closed while the tray is in an operating attitude and the sheet material (transfer material) is mounted therein, removable of jammed transfer material from the main body without opening and closing the tray, and it is also possible to prevent to accidentally dropping and damaging the transfer material while it is moved.

Furthermore, since the openable and closable member and the tray are formed in a unit structure so as to be detached as one body from the main body, assembling property and operability of the apparatus can be improved, and the shape of the tray housed within the openable and closable member can be made small.

In addition, since the tray is a paper-feed or paper-discharge tray, an operation for removing jamming in a paper-feed or paper-discharge unit can be greatly eased.

DESCRIPTION OF THE PREFERRED EMBODIMENTS

An embodiment of the present invention will now be explained by reference to FIGS. 1 through 5.

Figure 1:
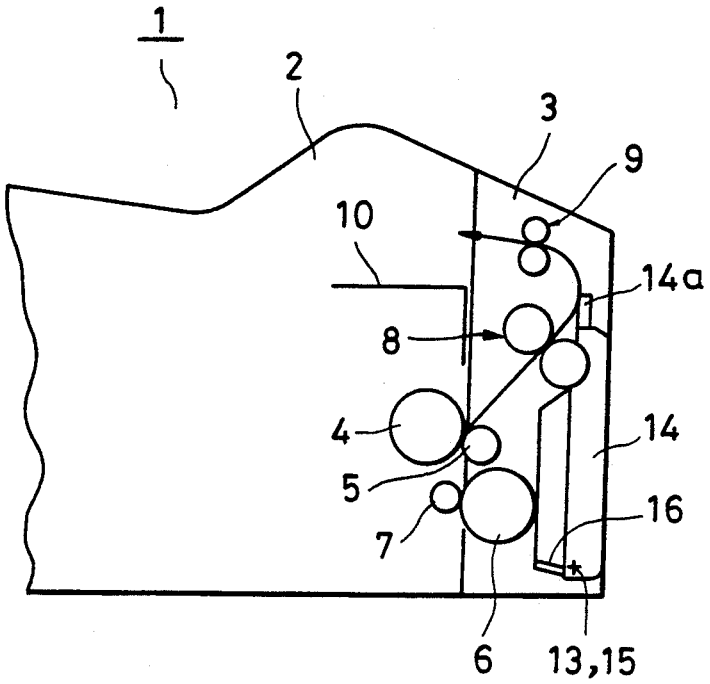
FIG. 1 is a sectional side view showing an embodiment of the present invention.

As shown in FIG. 1, a small printer (an image forming apparatus) 1 comprises two separate portions, that is, a main body 2 of the printer and a conveying unit 3. The conveying unit 3 consists of a paper-feed portion and a paper-conveying portion and is provided to the right of the main body 2. A photosensitive drum 4 is provided at the side in the main body 2, and a transfer roller 5 disposed facing the photosensitive drum 4 is mounted at the side in the conveying unit 3. A paper-feed roller 6 is provided upstream of transfer roller 5 and at the side of the conveying unit 3, and a conveying roller 7 is provided facing the paper-feed roller 6 at the side of the main body 2.

A pair of fixing rollers 8 are provided downstream from the transfer roller 5 inside the unit conveying 3, and a pair of discharge rollers 9 are provided downstreams from the fixing rollers 8, also inside the conveying unit 3. A sheet material is discharged in a horizontal direction shown by the solid-line arrow onto a frame 10 mounted on the main body 2.

Figure 2:
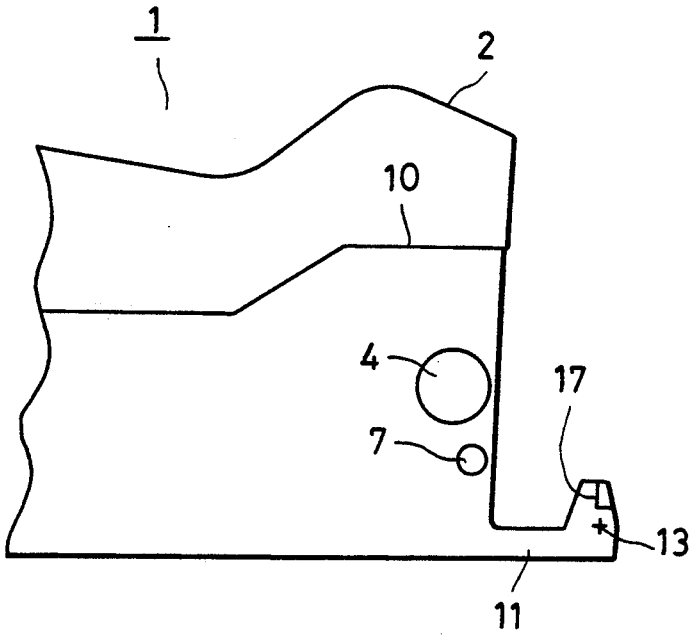
FIG. 2 is a sectional side view of the main body of the FIG. 1 apparatus.
Figure 3:
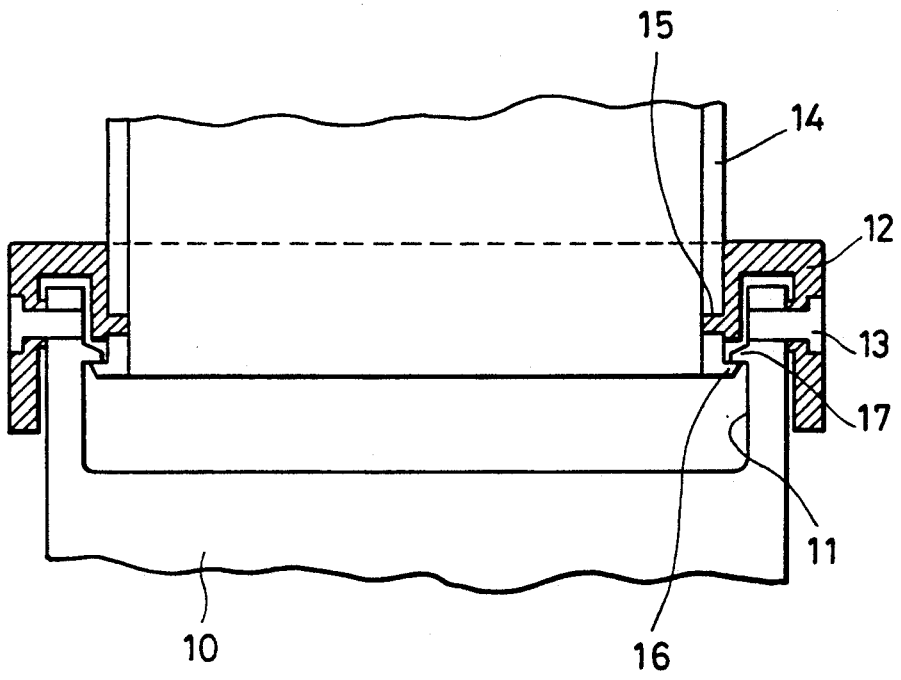
FIG. 3 is a cross-sectional plan view showing pivoting members of a tray.

As shown in FIGS. 2 and 3, two sides at the lower portion of the main-body frame 10 extrude to form arm members 11. Supporting arms 12 for the conveying unit 3 are disposed so as to surround the arm members 11, and are pivoted on the arm members 11 by pins 13.

Figure 4:
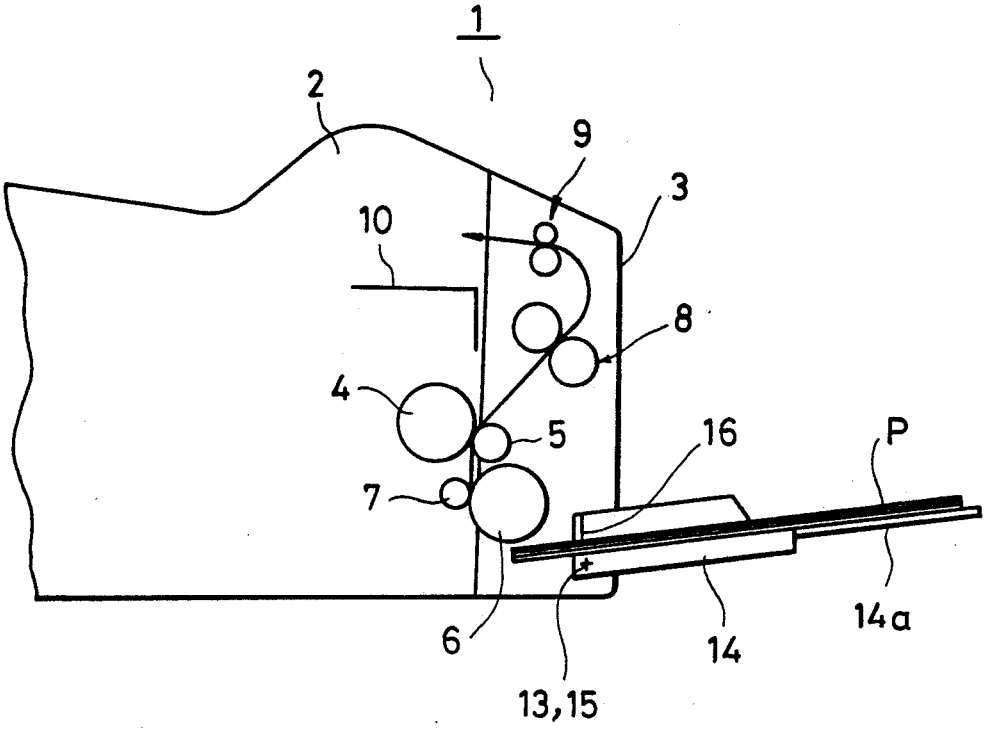
FIG. 4 is a sectional side view when the FIG. 1 apparatus is operating.

As shown in FIG. 3, paper-feed tray 14 is pivoted on end portions of the supporting arms 12 by pins 15, and the pins 13 and 15 are disposed on an identical axis. When the paper-feed tray 14 is opened, stoppers (protruded pieces) 16 provided on the paper-feed tray 14 anchor against contacting stoppers (protruded pieces) 17 provided near the ends of the arm members 11 as shown in FIG. 2. The paper-feed tray 14 is housed in the conveying unit 3, as shown in FIG. 1. Once opened, the tray 14 is fixed in its operating position as shown in FIG. 4. An auxiliary tray 14*a* is drawably mounted on the paper-feed tray 14.

The operation of the present embodiment will now be explained.

When the printer 1 is used, the paper-feed tray 14 is opened around the pins 15 (rotated in the clockwise direction in FIG. 1) from the state shown in FIG. 1. The stoppers 16 and 17 (shown in FIG. 2) are thereby engaged with each other, and the paper-feed tray 14 is fixed (held) at an operating position (the position shown in FIG. 4).

Subsequently, the auxiliary tray 14*a* is drawn, and a sheet material (recording medium) is mounted. After a sheet of the recording medium P has been fed by the paper-feed roller 6, an image is transferred onto the recording medium P from the photosensitive drum 4. The transferred image is then fixed by the pair of fixing rollers 8, and the sheet of the recording medium P on which the image is formed is discharged onto the main-body frame 10 by the pair of paper-discharge rollers 9.

Figure 5:
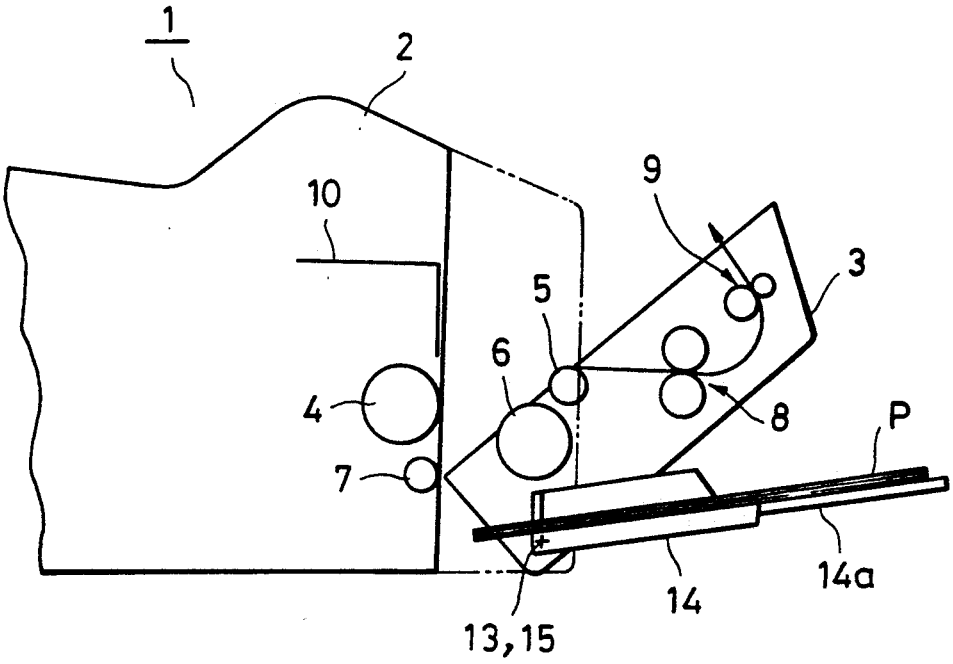
FIG. 5 is a sectional side view showing a state of processing for removing a recording medium that has jammed.

If a failure in the paper-feeding operation such as paper jam or the like occurs in the conveying unit 3, the conveying unit 3 is detached from the main body 2 by rotating it in a clockwise direction as shown in FIG. 5. The jammed sheet of the recording medium P can be easily removed once the conveying unit is positioned in the attitude shown in FIG. 5. At this time, since the pins 13 and 15 are on an identical axis, the position of the paper-feed tray 14 does not change. Accordingly, an operation to remove jammed paper can be performed with the paper feed tray in that operable attitude without moving the recording medium P on the tray 14 to some other location. The conveying unit 3 may also include engaging members that are brought into contact with stoppers 17 (FIGS. 2 and 3) to maintain its attitude, or may provide entirely different stoppers.

After the operation to remove jamming, the conveying unit 3 is mounted on the main body 2, as shown in FIG. 4, and the copying operation is resumed.

When the copying operation has been terminated, the remaining sheets of the recording medium P are removed and the auxiliary tray 14*a* is housed. The tray 14 is then rotated in a counterclockwise direction and housed in the conveying unit 3, as shown in FIG. 1.

Although, in the above-described embodiment, an explanation has been provided for a state in which the pins 13 and 15 are on an identical axis, the pins 13 and 15 do not necessarily need to be on an identical axis, but may be on nearly identical axes, because the attitude of an operating position of the tray 14 is not greatly changed.

Although, in the above-described embodiment, an explanation has been provided for a state in which the tray 14 is pivoted by the pins 15, the tray 14 does not necessarily need to be pivoted by the pins 15, but may be pivoted by the pins 13 or others.

Furthermore, although, in the above-described embodiment, a description has been provided of the case of a paper-feed tray, a paper-discharge tray may also have the same configuration and therefore the same effects, since an openable and closable cover and the like for an operation to remove jamming on a paper-discharge conveying path necessarily exist also in the case of the paper-discharge tray.

An image forming apparatus to which the present invention is applied will now be explained in detail.

Figure 6:
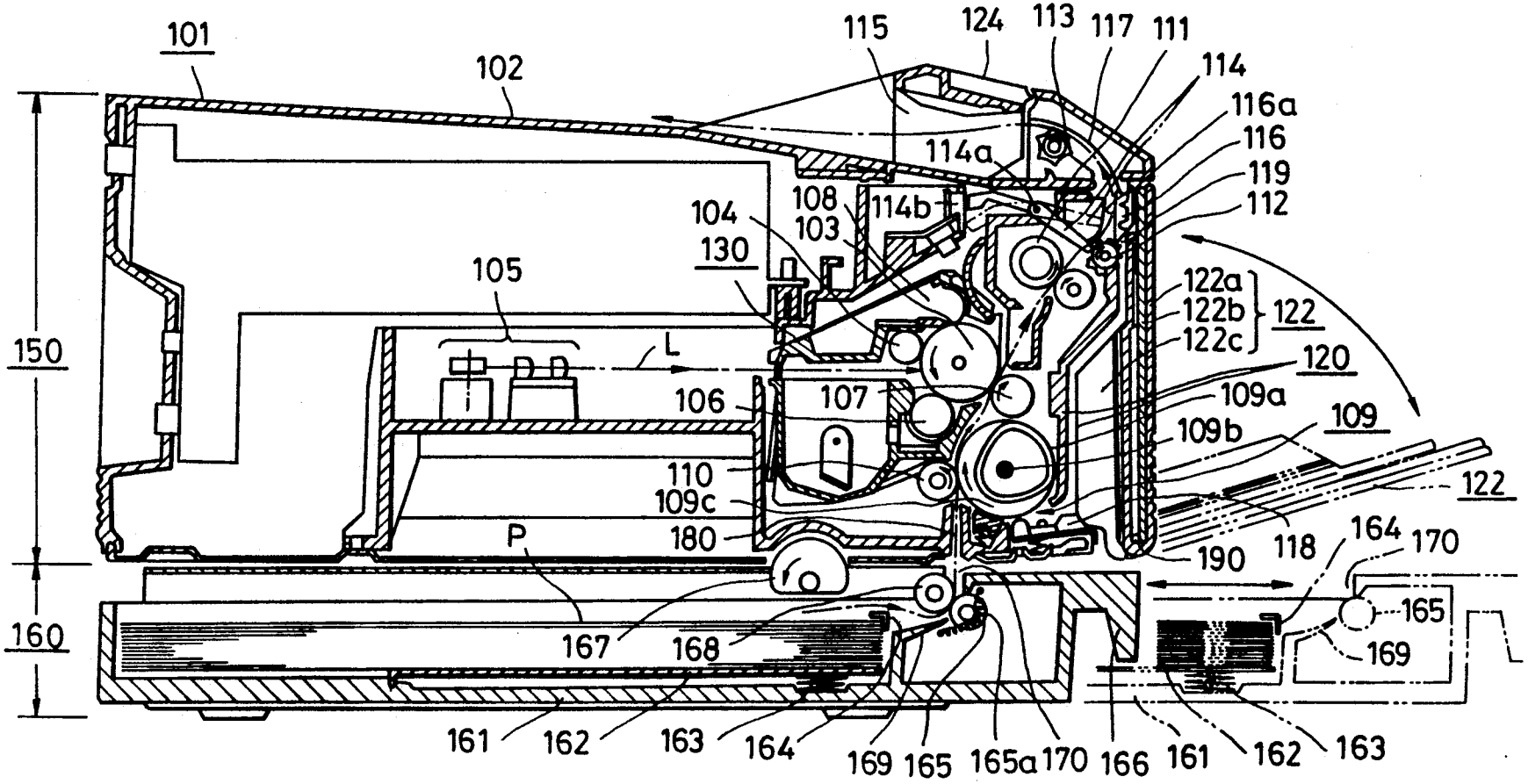
FIG. 6 is a vertical sectional side view showing in detail the internal configuration of an image forming apparatus to which the present invention is applied.

FIG. 6 is a sectional side view showing the schematic configuration of the inside of a laser-beam printer utilizing transfer-type electrophotography, serving as an embodiment of the image forming apparatus.

In FIG. 6, a main body unit 150 of the printer serves as an image forming means unit, and a cassette feeder unit 160 serves as a second paper-feed unit provided at a lower portion of the printer main body.

(I) Cassette feeder 160

The cassette feeder 160, serving as the second paper-feed unit, may be provided as a built-in apparatus forming one body together with the printer main body 150. Alternatively the cassette feeder 160 may be provided as a unit separate from the printer main body 150. The unit is used in combination with the printer main body 150 and is mounted and set by being positioned at a predetermined positon on the unit apparatus.

The cassette feeder 160 of the present embodiment invention includes an opening at its front-surface side (at the side of the right-end surface in FIG. 6) for inserting and removing a sheet-material-cassette 161. A sheet-material cassette 161 can be inserted as shown by solid lines, and from which the cassette 161 can be drawn as shown by two-dot chain lines.

The sheet-material cassette 161 includes an up-and-down-swinging intermediate base plate 162 disposed above the base of a sheet-material mounting and housing member by the biasing force of a spring 163, a sheet material (recording medium) P mounted and housed in the housing member, a pawl 164 for separating each sheet of the sheet material P, a sheet-material conveying roller 165, and a handle member 166 for inserting and removing the cassette using ones fingers.

There are also shown a paper-feed roller 167 and a sheet-material conveying roller 168 provided at the side of the main body of the cassette feeder. The paper-feed roller 167 is a semicircular roller which waits in a rotation-angle attitude wherein its noncircular portion is downwardly situated. Every time a paper-feed start signal is issued from a control system (not shown), a rotation force from a driving system (not shown) is transmitted via a single-rotation clutch, and the paper-feed roller 167 is driven by one revolution in the counterclockwise direction as shown by the arrow. The sheet-material conveying roller 168 receives a rotation force from a driving system (not shown) via a clutch controlled by a control system (not shown), and is rotatably driven in the counterclockwise direction (shown by the arrow) from the moment with a predetermined timing for a predetermined period.

When the sheet-material cassette 161 is inserted within the cassette feeder 160 from the opening at the front-end side of the cassette feeder 160, and is mounted sufficiently pushing it until further insertion is hindered by a stopper member, the sheet-material conveying roller 165 situated at the side of the cassette 161 contacts the sheet-material conveying roller 168 situated at the side of the cassette feeder 160. The contact state is stably maintained by a pressing force of a spring 165*a* in contact with the shaft of the roller 165. A condition is then provided in which the semicircular paper-feed roller 167 is situated near the insertion opening and above an upper-surface portion of the sheet material P housed in the sheet-material mounting and housing member in the cassette 161.

If the semicircular paper-feed roller 167 is driven by an amount equal to a single rotation, a drawing force in a direction opposite to the inserting and mounting direction of the cassette 161 is exerted on the uppermost sheet of the sheet material P mounted within the cassette 161. The uppermost sheet is thereby separated from the sheets below it by the separation pawl 164, and is fed from the sheet-material mounting and housing member.

The fed sheet is guided by an upwardly-angled guide plate 169, enters a nipped portion between the sheet-material conveying rollers 168 and 165 contacting each other, and is conveyed in an upward direction from an upwardly-guiding exit member 170 of the cassette feeder 160 by the rotation driving force of the roller 168 and the followed rotation of the roller 165.

At the side of the base of the printer main body 150, there is downwardly provided a sheet-material entrance 180. The entrance serves as a second paper-feed opening, and it is positioned facing and corresponding to the upwardly-guiding exit member 170 at the side of the cassette feeder 160. Accordingly, the sheet upwardly conveyed from the upwardly-guiding exit member 170 of the cassette feeder 160 then enters the printer main body 150 through the sheet-material entrance member 180, serving as the second paper-feed opening.

(II) Printer main body 150

The case 101 of the printer main body 150 has an upper faceplate 102 provided as a built-in tray serving as a first paper-discharge member. The case 101 incorporates image forming means, that is, a rotating-drum-type electrophotographic photosensitive drum 103 (corresponding to the photosensitive drum 4 in FIG. 4, and termed hereinafter a "drum"), a contact charging roller 104 serving as means for uniformly charging the surface of the drum, a laser-beam scanner 105, a developing unit 106, a transfer roller 107 (corresponding to the roller 5 in FIG. 1), a cleaning unit 108, a sheet-material separating and feeding assembly 109 (corresponding to the paper-feed roller 6 in FIG. 1) for separating and feeding each sheet of the sheet material mounted on a paper-feed tray 122 serving as a first paper-feed member (to be described later), a sheet-material conveying roller 110 (corresponding to the roller 7 in FIG. 1) subjected to pressure contact with an idler roller 109*c* of the assembly 109, a fixing unit 111 (corresponding to the pair of rollers 8 in FIG. 1), first and second paper-discharge rollers 112 and 113, a conveyed-sheet-material detection lever 114, various kinds of electric units for driving sources and control systems, and the like.

The sheet is conveyed from the upwardly-guiding exit member 170 of the cassette feeder 160, enters the downwardly-provided entrance 180, which entrance serves as the second paper-feed opening, and is situated at the side of the base of the printer main body 150, and is thus supplied to the printer main body 150. There the sheet is conveyed between the conveying roller 110 and the idler roller 109*a*, the drum 103 and the transfer roller 107, the pair of fixing rollers of the fixing unit 111, and then through the second paper-discharge roller 112 and the first paper-discharge roller 113. The sheet is discharged from the main body 150 via a first paper-discharge opening 115 onto the tray 102, serving as the first paper-discharge member, on the upper surface of the printer case.

The above-described sheet-material conveying path from the downwardly-provided sheet-material entrance 180, serving as the second paper-feed opening, situated at the side of the base of the printer main body 150, which is an opening for receiving a sheet fed from the side of the cassette feeder 160, up to the first paper-discharge roller 113 is a nearly vertical sheet path rising and extending from the side of the base faceplate to the side of the upper faceplate of the printer case at a side close to the front faceplate 120 (the faceplate at the right-end side in FIG. 6) within the printer main body.

In response to a print start signal, the drum 103 is rotatably driven in the counterclockwise direction at a predetermined circumferential speed, and the surface of the rotating drum is uniformly charged in positive or negative polarity by the contact charging roller 104. As a result of subsequent scanning and exposure by a laser beam L output from the laser-beam scanner 105, an electrostatic latent image corresponding to object image information is formed on the charged surface of the drum 103. The latent image thus formed is then developed as a toner image by the developing unit 106.

On the other hand, as described above, as a result of a single rotation of the paper feed roller 167 and the rotation of the conveying roller 168 performed in the cassette feeder 160, the uppermost sheet of the sheet material P mounted within the cassette 161 is conveyed through the upwardly-guiding exit member 170 of the feeder 160, and through the downwardly-provided entrance 180 into the printer main body 150, where it is conveyed from below to above along the above-described nearly vertical sheet path.

That is, the sheet passes between the conveying roller 110 rotatably driven in a counterclockwise direction as shown by the arrow and the idler roller 109*c* of the sheet-material separating and feeding assembly 109, and is guided between the drum 103 and the transfer roller 107 by a guide, whereby the toner image formed and carried on the surface of the drum 103 is sequentially transferred to the sheet. The sheet, on which the image has been transferred while passing between the drum 103 and the transfer roller 107, is separated from the surface of the drum 103, and is guided within the fixing unit 111 by a guide. The image on the sheet is fixed while the sheet passes between the pair of fixing rollers rotatably driven in the counterclockwise direction as shown by the arrow.

The sheet which has passed through the fixing unit 111 pushes up the sheet-material detection lever 114 in a counterclockwise direction as shown by two-dot chain lines around a supporting shaft 114*a*, and is discharged onto the tray 102 with the image surface faced down. The discharge route is via the second paper-discharge roller 112 rotatably driven in the counterclockwise direction, a first guide surface 116*a* of a movable guide 116 held in a first attitude, the surface of a guide 117 inwardly curved toward the direction of the tray 102 serving as the first paper-discharge member, the first paper-discharge roller 113 rotatably driven in the counterclockwise direction, and the first paper-discharge opening 115.

When the rear end of the sheet which left the fixing unit 111 has passed the position of the sheet-material detection lever 114, and interference between the lever 114 and the sheet has disappeared, the lever 114 rotates in the clockwise direction around the supporting shaft 114*a* by its own weight, and returns to a rotation attitude as shown by solid lines. The above-described swinging movement of the lever 114 accompanying the passage of the sheet through the position of the lever is detected by a sensor 114*b*, such as a photointerrupter, and operations, such as timing control for feeding the sheet and detection of jamming are performed.

(III) Mechanism to open the inside of the printer

Figure 7:
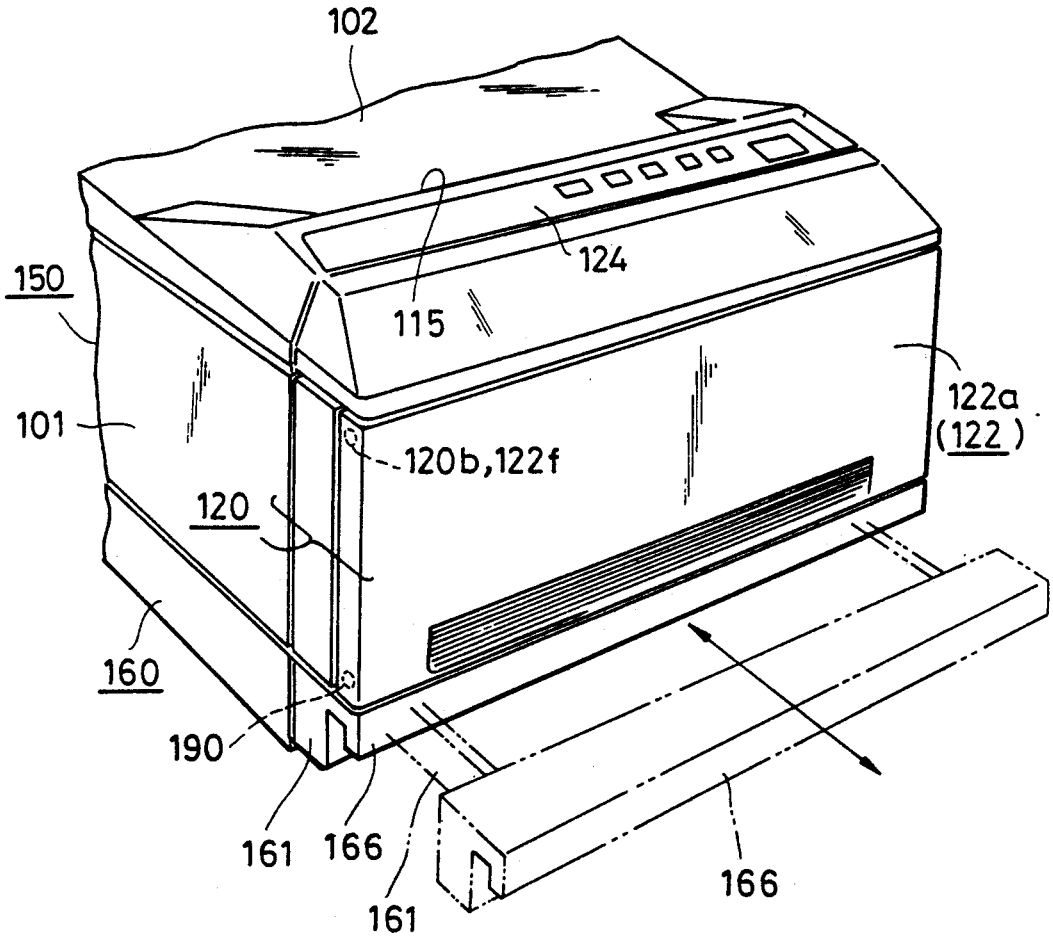
FIG. 7 is a perspective view of the FIG. 6 apparatus, as seen from the right side.
Figure 8:
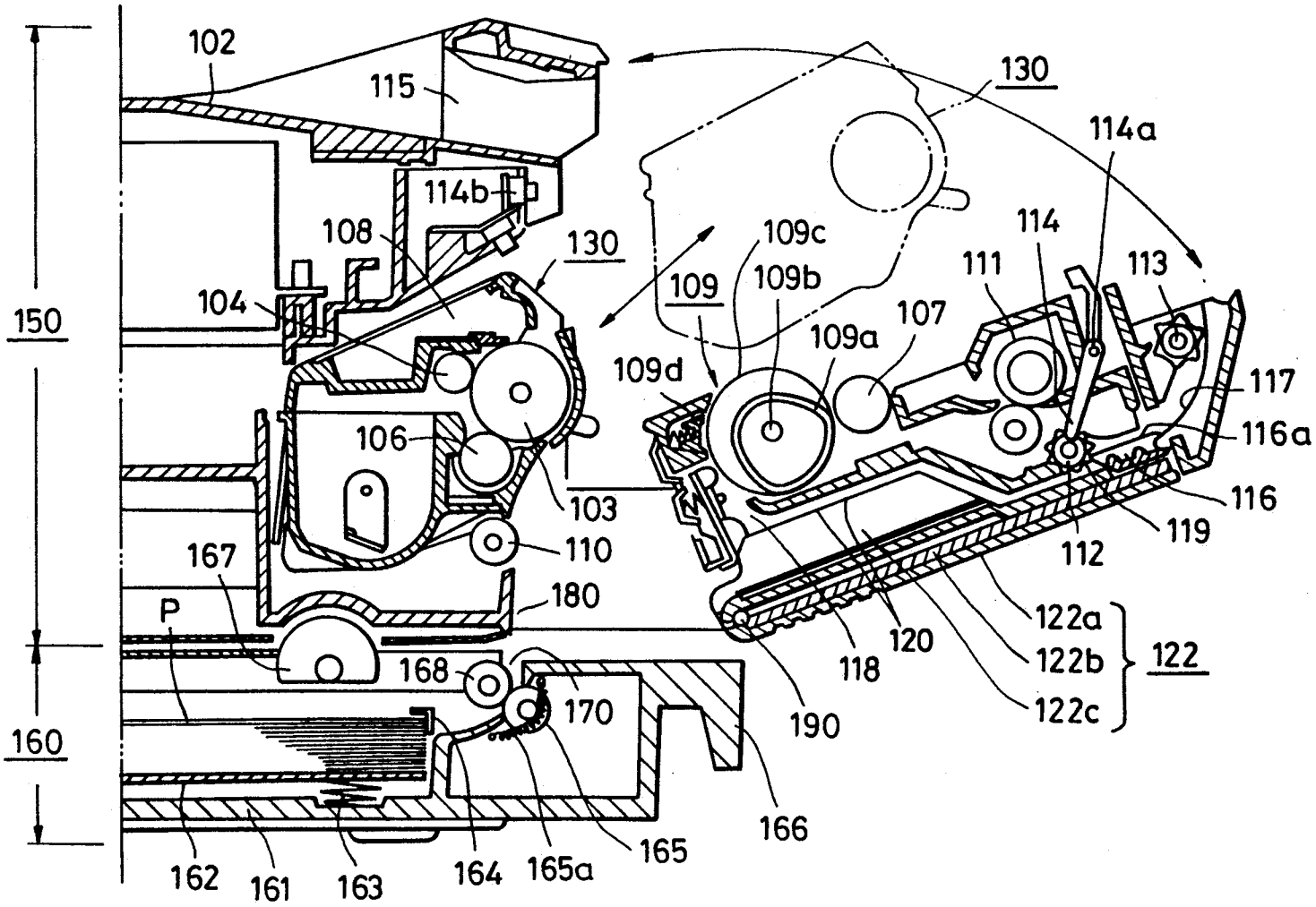
FIG. 8 is a partial sectional side view showing a state in which an openable and closable member (paper-feed unit) is opened.

In the printer main body 150 shown in FIG. 6, the front faceplate 120 of the case 101 serves as an openable and closable front cover of the printer main body. It is mounted so as to be rotatably closed in and opened down relative to the front surface of the cover 101 around a horizontal shaft 190 of a hinge situated at a lower portion. FIGS. 6 and 7 show a state in which the faceplate 120 is closed and FIG. 8 shows a state in which the faceplate 120 is opened down to expose the inside of the printer main body.

Bordering the above-described nearly vertical sheet path within the printer main body 150 is the image formation processing unit. The image formation processing units are at the side of the front cover 120 and consists of the separating and feeding assembly 109 for each sheet material, the transfer roller 107, the fixing unit 111, the sheet-material detection lever 114, and the second and first paper-discharge roller 112 and 113, which are assembled and supported at the side of the back surface of the front cover 120 in a predetermined arrangement relation. Also, bordering the nearly vertical sheet path are the image formation processing units at the side of the case 101, that is, the sheet-material conveying roller 110, the drum 103, the contact charging roller 104, the developing unit 106, the cleaning unit 108, and the main electric units for driving sources and control systems, all of which are assembled within the case 101 in a predetermined arrangement relation.

Figure 9:
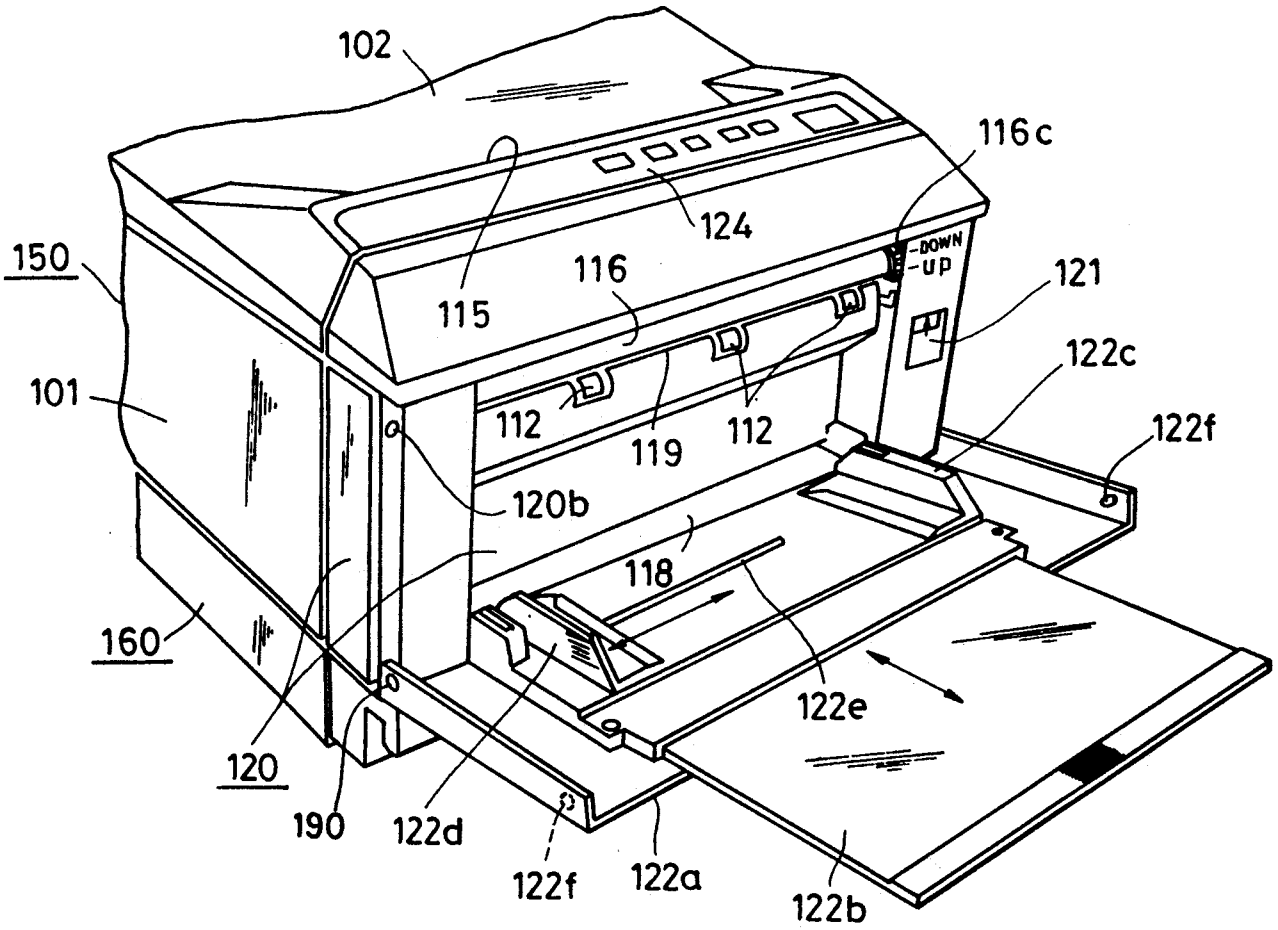
FIG. 9 is a perspective view showing a state in which a paper-feed tray is opened.

The closed-in state of the front cover 120 relative to the case 101, as shown in FIG. 6, is stably maintained by a locking mechanism (not shown). In FIG. 9, there is shown a knob 121 for releasing the locking. By operating the knob 121, the front cover 120 (corresponding to the unit 3 in FIG. 1) can be opened from the front surface of the case 101 around the horizontal shaft 190 of the hinge which comprises a paper-feed unit support means, and it is possible to provide a state in which the front conver 120 is opened until it is received by a rotation restriction member, that is, a state in which the inside of the printer main body 150 is opened to expose the area bordering the above-described nearly vertical path, as shown in FIG. 8.

According to this opening operation, removal of a sheet that has jammed within the nearly vertical sheet path, maintenance of internal components within the printer, and the like can be eased. Furthermore, in the printer of the present embodiment, four of the image formation processing units, that is, the drum 103, the contact roller 104 for primary charging, the developing unit 106 and the cleaning unit 108, are assembled within a common cartridge housing as a process cartridge 130 to be detachably mounted at a predetermined position within the main body of the printer. As shown in FIG. 8, the process cartridge 130 is mounted on and demounted from the printer main body 150 at a predetermined position within the case 101 by opening the front cover 120 to its fullest open position to expose the inside of the printer.

(IV) First paper-feed member and second paper-discharge member

In FIG. 9, lateral slit openings 118 and 119 serve as a first paper-feed opening and a second paper-discharge opening provided at a lower-side position and at an upper-side position of the above-described openable and closable front cover 120, respectively.

In FIG. 6, a paper-feed tray 122 (corresponding to the tray 14 in FIG. 1) serves as a first paper-feed member for the first paper-feed opening 118. The tray 122 can be rotatably switched between a raised and closed position (wherein as depicted in FIG. 9 a pin 122*f* and a hole 120*b* are engaged with each other). In the closed position the tray 122 is folded and held at its lower side relative to the front cover 120, as shown by solid lines, around the horizontal shaft 190 of the hinge (also serving as the horizontal shaft of the hinge of the front cover 120). In the opened position the tray 122*f* is outwardly projected and opened in an attitude having a predetermined forwardly-raised tilt angle from the front surface of the front cover 120 and is held by the rotation restriction member, as shown by two-dot chain lines.

As shown by the solid lines in FIG. 6, when the paper-feed tray 122 is folded, both the first paper-feed opening 118 and the second paper-discharge opening 119 situated at the lower side and the upper side of the front cover 120, respectively, are held in a closed state because the folded paper-feed tray 122 functions as a closing door. Hence, penetration of foreign matter, such as dust and the like, through openings 118 and 119 into the main body of the apparatus can be prevented. In the state in which the front cover 120 is tilted and opened as shown by the two-dot chain lines, the first paper-feed opening 118 and the second paper-discharge opening 119 are in an opened state.

The paper-feed tray 122, serving as the first paper-feed member, in the present embodiment comprises a main tray 122*a* and an articulated subtray 122*b* provided so as to be drawn out and pushed in forward and backward directions relative to the main tray 122*a*. By drawing out the subtray 122*b* when the main tray 122*a* is outwardly tilted and opened, it is possible to extend the entire length of the paper-feed tray in the direction of paper feeding, and hence to mount and set larger-sized sheet material.

Figure 10:
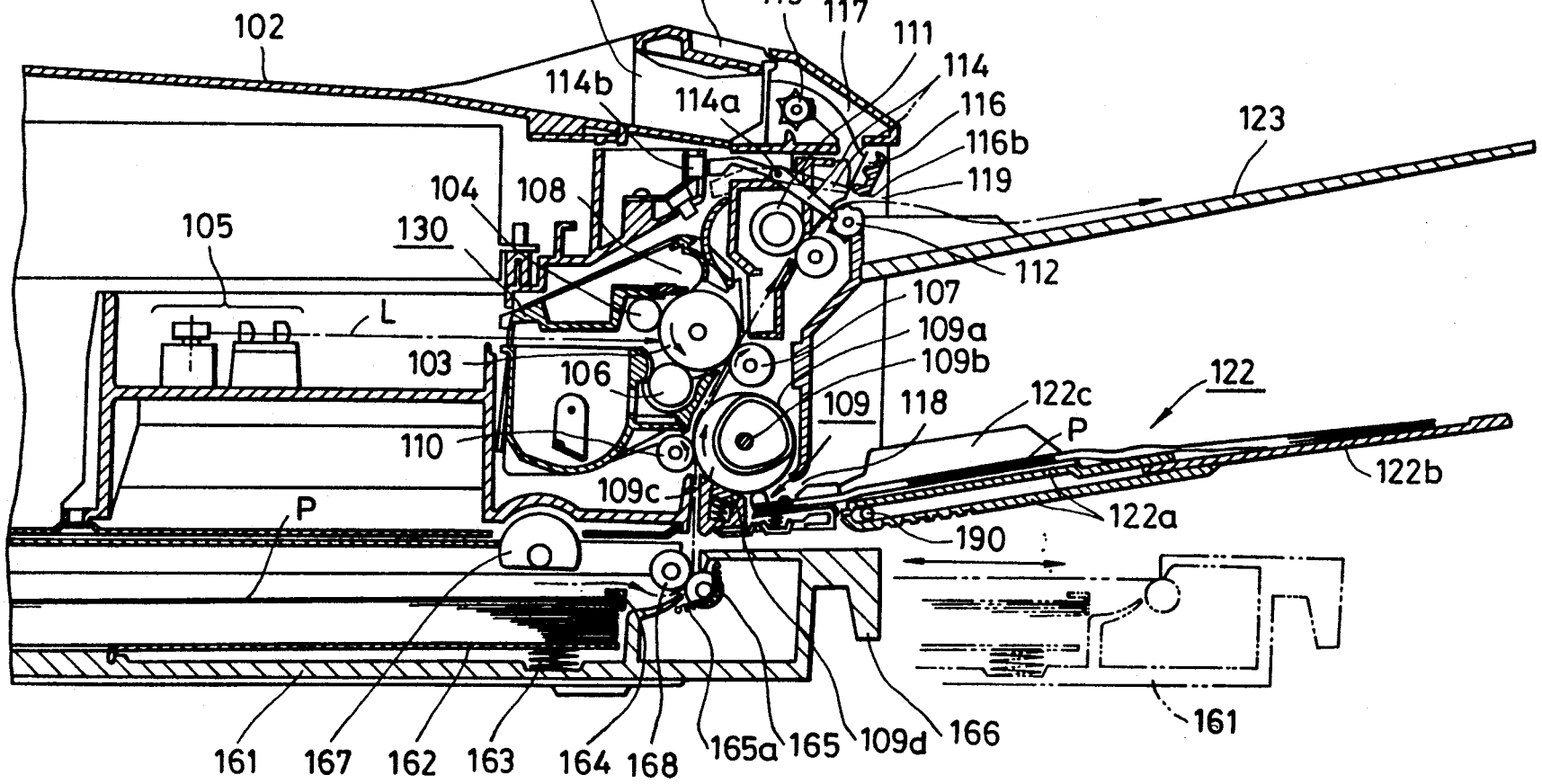
FIG. 10 is a sectional side view showing a state in which the paper-feed tray is opened and a paper-discharge tray is mounted.

FIGS. 9 and 10 show the state in which the paper-feed tray is tilted and opened. In FIG. 9, there is shown right and left guides (side checks) 122*c* and 122*d* for a mounted sheet material provided in the main tray 122*a*. The guide 122*c* is fixed, and the guide 122*d* is movable along a guide groove 122*e* in the direction of the width of the main tray 122*a*. The spacing between the two guides 122*c* and 122*d* can be freely adjusted in accordance with the width of a sheet material P to be used.

The sheet material P is mounted and set on the paper-feed tray 122 by inserting its front-end portion up to a predetermined position in the paper-feed opening 118 and positioning the right and left edges of the sheet material P with the guides 122*c* and 122*d*.

In FIG. 10, a paper-discharge tray 123, serving as a second paper-discharge member for the second paper-discharge opening 119, is detachably mounted by engagement between pins and hooks (not shown) at a position corresponding to the paper-discharge opening 119 in the front cover 120.

When the paper-feed tray 122 is folded against the front surface of the front cover 120 (as shown by the solid lines in FIG. 6), the front surface of the movable guide 116 is pushed by the inner surface of the subtray 122*b* and housed within the main tray 122*a*, and the movable guide 116 is thereby rotated and maintained in a first position. The path of the sheet, which has been fed from the cassette feeder 160, serving as the second paper-feed member, to the printer main body 150 and has passed through the fixing unit 111 and the second paper-discharge roller 112 as described above, is regulated in a direction toward the first paper-discharge member 102 by a first guide surface 116*a* of the movable guide 116 held in the first attitude.

Also, when the paper-feed tray 122 is tilted and opened from the front surface of the front cover 120, the movable guide 116 is kept in the first position.

When the paper-feed tray 122 is tilted and opened from the front surface of the front cover 120, and the paper-discharge tray 123 is mounted on the front surface of the front cover 120 by engagement between the pins and hooks (not shown), a projection 116*d* situated at a lower portion of the knob 116*c* is pushed by a part of the mounted paper-discharge tray 123, and the movable guide 116 is thereby switched and held from the state of the first position to a second position. The path of the sheet, which has passed through the fixing unit 111 and the second paper-discharge roller 112, is thereby adjusted in a direction moving from the second paper-discharge opening 119 toward the paper-discharge tray 123, serving as the second paper-discharge member, by a second guide surface 116*b* of the movable guide 116.

In FIG. 10, if a paper-feed mode from the first paper-feed member 122 is assigned by an operation panel (console panel) 124 and a print-start button is depressed, the drum 103 is rotatably driven and image formation on the surface of the drum 103 is executed as described above.

Figure 11:
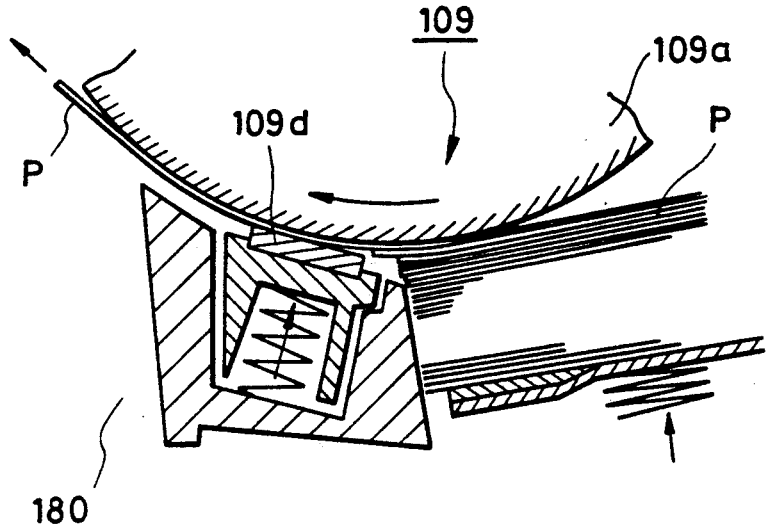
FIG. 11 is an enlarged view of the paper-feed unit.

On the other hand, due to the drive of the paper-feed roller 109*a* of the separating and feeding assembly 109 for each sheet material by an amount of a single rotation in the clockwise direction around a shaft 109*b*, a drawing force is exerted on the uppermost sheet of the sheet material P mounted on the paper-feed tray 122. Only the uppermost sheet is separated from the remaining sheets in tray 122 by a separation pad 109*d* mainly composed of a frictional member. The drawn in sheet then passes through a contact nipped portion between separation pad 109*d* and the paper-feed roller 109*a*, and is drawn within the main body of the printer, as shown in FIG. 11. The drawn-in sheet passes between the conveying roller 110 and the idler roller 109*c*, and is fed to the above-described nearly vertical sheet path in the image formation processing means unit, as in the case depicted in FIG. 6 of the above-described sheet fed from the side of the cassette feeder 160. The image formed on the surface of the drum 103 is transferred to the sheet while the sheet passes between the drum 103 and the transfer roller 107. The transferred image is fixed while the sheet passes through the fixing unit 111.

Figure 12:
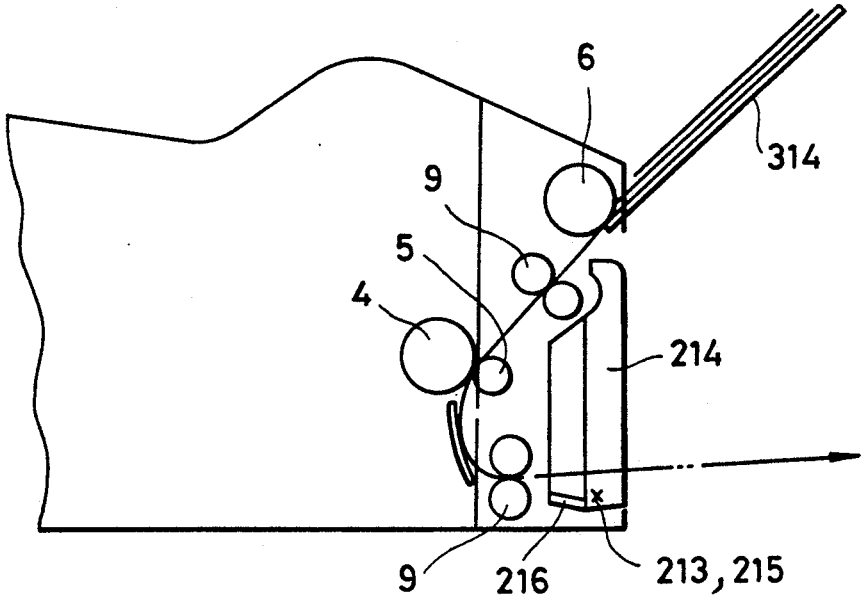
FIG. 12 is a sectional side view showing an embodiment in which the present invention is applied to a paper-discharge tray.

FIG. 12 shows an embodiment in which the present invention is applied to a paper-discharge tray. In FIG. 12, like components as those in FIG. 1 are indicated by like numerals. A paper-discharge tray 214 has the same configuration as that of the tray 14 shown in FIG. 1, and mounts a sheet material discharged by the pair of rollers 9. A paper-feed tray 314 mounts a sheet material to be fed.

Although, in the embodiments shown in FIGS. 1 and 12, the paper-feed tray (paper-discharge tray) is supported in the unit 3, the paper-feed tray and the like may be swingably supported in the main body of the apparatus. In that case, the position relationship between the unit 3 and the paper-feed tray (paper-discharge tray) must be the same as that in FIGS. 1 and 12, so that the tray can be housed in or taken out of the unit 3. Furthermore, the tray and the unit 3 may also be swung as one body.

What is claimed is:

1. An image forming apparatus comprising:

a main body;

a paper-feed unit;

paper-feed unit support means for openably and closably supporting said paper-feed unit by said main body;

a tray attached to and supported by said paper-feed unit, said tray mounted so as to be swingable between a non-operating position wherein said tray is housed in a generally vertical position in said paper-feed unit and an operating position wherein said tray is in a position for mounting a sheet material; and stopper means provided in said main body of the image forming apparatus for holding said tray at the operating position, wherein said paper-feed unit support means positions the paper-feed unit in either the opened or the closed state while said tray is held at the operating position.

2. An image forming apparatus according to claim 1, further comprising a conveying path for the sheet material, said conveying path positioned so as to be exposed when the paper-feed unit is in an opened position.

3. An image forming apparatus according to claim 2, wherein the paper-feed unit support means pivotally supports said paper-feed unit about a first shaft attached to a lower portion of the main body, and the tray is pivotally attached to a second shaft attached to a lower portion of the paper-feed unit.

4. An image forming apparatus according to claim 3, wherein the conveying path extends in a nearly vertical direction.

5. An image forming apparatus comprising:

a main body;

a paper-feed unit, paper-feed unit support means for openably and closably supporting said paper-feed unit by said main body;

a tray attached to and supported by said paper-feed unit, said tray mounted so as to be swingable between a non-operating position wherein said tray is housed in a generally vertical position in said paper-feed unit and an operating position wherein said tray is in a position for mounting a sheet material;

stopper means provided in said main body of the image forming apparatus for holding said tray at the operating position, wherein said paper-feed unit support means positions the paper-feed unit in either the opened or the closed state while said tray is held at the operating position; and a conveying path for the sheet material, said conveying path extending in a nearly vertical direction and positioned so as to be exposed when the paper-feed unit is in an opened position, wherein the paper-feed unit support means pivotally supports said paper-feed unit about a first shaft attached to a lower portion of the main body, and the tray is pivotally attached to a second shaft attached to a lower portion of the paper-feed unit, wherein the second shaft and the first shaft are on substantially the same axis.

6. An image forming apparatus according to claim 5, wherein the tray is positioned below a paper discharge opening for receipt of discharging paper.

7. An image forming apparatus according to claim 5, wherein the tray is positioned below a paper intake opening for feeding paper.

8. An image forming apparatus according to claim 7, wherein the tray serves as an outer wall of the main body of the apparatus while in the non-operating position.

9. An image forming apparatus according to claim 6, wherein the tray serves as an outer wall of the main body of the apparatus while in the non-operating position.

10. An image forming apparatus comprising:

a main body;

a paper-feed unit;

paper-feed unit support means for openably and closably supporting said paper-feed unit by said main body;

a tray attached to and spported by said paper-feed unit, said tray mounted so as to be swingable between a non-operating position wherein said tray is housed in a generally vertical position in said paper-feed unit and an operating position wherein said tray is in a position for mounting a sheet material;

stopper means provided in said main body of the image forming apparatus for holding said tray at the operating position, wherein said paper-feed unit support means positions the paper-feed unit in either the opened or the closed state while said tray is held at the operating position; and a conveying path for the sheet material, said conveying path positioned so as to be exposed when the paper-feed unit is in an opened position, wherein the paper-feed unit support means pivotally supports said paper feed unit about a shaft attached to a lower portion of the main body, and the tray is pivotally attached to said shaft.

11. An image forming apparatus comprising:

a main body;

a paper-feed unit;

paper-feed unit support means for openably and closably supporting said paper-feed unit by said main body;

a tray attached to and supported by said paper-feed unit so as to be swingable between a non-operating position wherein said tray is housed in a generally vertical position in said paper-feed unit and an operating position for mounting a sheet material wherein said tray is opened; and stopper means provided in said main body of the apparatus for holding said tray at the operating position when the paper-feed unit is opened.

12. An image forming apparatus according to claim 11, wherein a conveying path for the sheet material is exposed when the paper-feed unit is in an opened position.

* * * * *

UNITED STATES PATENT AND TRADEMARK OFFICE

CERTIFICATE OF CORRECTION

PATENT NO. : 5,085,422

DATED : February 4, 1992

INVENTOR(S) : SEIJI SAGARA

It is certified that error appears in the above-identified patent and that said Letters Patent is hereby corrected as shown below:

COLUMN 2

Line 16, "Futhermore," should read --Furthermore,--.

COLUMN 3

Line 20, "unit conveying 3," should read --conveying unit 3,--.
Line 22, "streams" should read --stream--.

COLUMN 8

Line 12, "conver" should read --cover--.
Line 51, "tray 122f" should read --tray 122--.

COLUMN 12

Line 9, "spported" should read --supported--.
Line 26, "paper feed" should read --paper-feed--.

Signed and Sealed this

Seventeenth Day of August, 1993

Bruce Lehman

*Attest:*

BRUCE LEHMAN

*Attesting Officer*

*Commissioner of Patents and Trademarks*